US006502276B2

(12) United States Patent
Iversen

(10) Patent No.: US 6,502,276 B2
(45) Date of Patent: Jan. 7, 2003

(54) VACUUM HOSE AND CORD HOLDER

(76) Inventor: Edward P. Iversen, 14 Woodview La., Algonquin, IL (US) 60102

( * ) Notice: Subject to any disclaimer, the term of this patent is extended or adjusted under 35 U.S.C. 154(b) by 0 days.

(21) Appl. No.: 09/864,796

(22) Filed: May 24, 2001

(65) Prior Publication Data

US 2002/0174508 A1 Nov. 28, 2002

(51) Int. Cl.[7] ..... A47L 9/00
(52) U.S. Cl. ..... 15/323; 15/246.2
(58) Field of Search ..... 15/323, 246.2

(56) References Cited

U.S. PATENT DOCUMENTS

| | | | | | |
|---|---|---|---|---|---|
| 1,896,933 | A | * | 2/1933 | Anastasi | 15/323 |
| 1,970,576 | A | * | 8/1934 | Replogle et al. | 15/323 |
| 2,145,723 | A | | 1/1939 | Holm-Hansen | |
| 2,337,364 | A | | 12/1943 | Ashbaugh | |
| 2,450,172 | A | | 9/1948 | Stoner | |
| 2,506,897 | A | | 5/1950 | Sheker | |
| 2,713,696 | A | | 7/1955 | Gorham | |
| 3,030,650 | A | | 4/1962 | Kiraly | |
| 3,509,590 | A | * | 5/1970 | Koshiyama | 15/323 |
| 4,563,789 | A | | 1/1986 | Berfield | |
| 4,697,299 | A | | 10/1987 | Brinkhoff et al. | |
| 5,137,156 | A | * | 8/1992 | Riczinger et al. | 15/323 |
| 5,303,447 | A | * | 4/1994 | McKnight | 15/323 |
| 5,331,714 | A | * | 7/1994 | Essex et at. | 15/323 |
| 6,058,559 | A | * | 5/2000 | Yoshimi et al. | 15/323 |
| 6,079,080 | A | * | 6/2000 | Rutter et al. | 15/323 |
| 6,175,988 | B1 | | 1/2001 | White et al. | |

* cited by examiner

*Primary Examiner*—Theresa T. Snider
(74) *Attorney, Agent, or Firm*—Mathew Perrone, Jr.

(57) ABSTRACT

A vacuum cord and hose holder has a base with a pair of oppositely disposed wings protruding upwardly therefrom to support the vacuum hose. Adjacent to each of the wings is an arcuate slot, providing a pair of arcuate slots adapted to receive the vacuum hose. On one wing is the cord hook, in which the vacuum cord may be received for storage.

17 Claims, 5 Drawing Sheets

VACUUM HOSE AND CORD HOLDER

This invention relates to a vacuum cord and hose holder and more particularly to a vacuum cord and hose holder for use with any vacuum cleaner, especially a vacuum cleaner suitable for cleaning a shop area.

BACKGROUND OF THE INVENTION

A vacuum cleaner is a well-known device for cleaning a number of different surfaces. Such a device may be used in a home, in a vehicle, in an industrial setting, or any setting, which requires removal of undesirable material from a surface. Commonly, an industrial setting uses a type of vacuum cleaner, which functions well in an extremely dirty situation. Typically, such cleaning in a workshop or similar area requires a heavy-duty vacuum cleaner.

In a workshop, a vacuum cleaner, with its hose and electric power cord, becomes difficult to store. In particular, the heavy-duty vacuum cleaner and the requirements for the cord and hose therefore cause great storage and utilitarian difficulties. It is very desirable to minimize the storage difficulties, while at the same time, keeping the cord and hose ready for use.

Many storage devices are known for the cord and hose. Most of these prior art devices suffer from the defect of being difficult to use and being ineffective. Critical features of a storage device for a cord and a hose of a vacuum cleaner are the ease of placing the hose and the cord in the storage device and the reverse operation of removing the cord and the hose from the storage device for efficient use.

Unfortunately, most of the storage devices of the prior art are difficult to use in either direction. Great care must be used whether placing the cord and vacuum hose in the holder for storage or removing the cord and vacuum hose from the holder for use. The storage device having ease of storage provides difficult removal. The storage device having ease of removal therefrom provides difficult storage. It is a great advantage to overcome the obstacles resulting therefrom.

It is especially desired to provide a storage device for the cord and the hose of the vacuum cleaner having both ease of storage and ease of removal. No device of the prior art offers these features.

Another major difficulty of the hose and cord storage device is the difficulty of applying such a device to an existing vacuum cleaner. This hose and cord storage device must be easily applied to the vacuum cleaner without causing interference of the function thereof. It must also be easily attachable thereto. No such device is known the prior art.

SUMMARY OF THE INVENTION

Among the many objectives of this invention is the provision of a vacuum cord and hose holder providing both ease of removal and ease of storage.

Another objective of this invention is to provide a movable vacuum cord and hose holder.

Yet another objective of this invention is to provide a vacuum cord and hose holder, which is easily attached an existing vacuum cleaner.

Still another objective of this invention is to provide a vacuum cord and hose holder added to a vacuum cleaner during manufacture.

Additionally, an objective of this invention is to a vacuum cord and hose holder for a heavy-duty vacuum cleaner.

Also, an objective of this invention is to provide a vacuum cord and hose holder with minimized interference with the vacuum cleaner.

A still further objective of this invention is to provide a vacuum cord and hose holder adapted to receive the vacuum hose easily.

Yet a further objective of this invention is to provide a vacuum cord and hose holder adapted to receive the cord easily.

These and other objectives of the invention (which other objectives become clear by consideration of the specification, claims and drawings as a whole) are met by providing a vacuum cord and hose holder, the vacuum cord and hose holder including a base with a pair of oppositely disposed wings protruding upwardly therefrom to support the vacuum hose. Adjacent to each of the wings is an arcuate slot, providing a pair of arcuate slots adapted to receive the vacuum hose. On one wing is the cord hook, in which the vacuum cord may be received for storage.

BRIEF DESCRIPTION OF DRAWINGS

Throughout the figures of the drawings where the same part appears in more than one figure, the same number is applied thereto.

DESCRIPTION OF PREFERRED EMBODIMENTS

A vacuum cord and hose holder uses a pair of opposing wings extending from a base. Mounted on one of the opposing wings is a cord hanger adapted to receive a cord. Thus, the vacuum cord and hose holder provides a convenient place to store those items on a vacuum cleaner. This vacuum cord and hose holder is attached to a vacuum cleaner in any suitable fashion.

Additionally, the vacuum cord and hose holder may be molded as a part of the vacuum cleaner, preferably on a top portion thereof. In this fashion, the vacuum cord and hose holder may be an integral part of the vacuum cleaner.

In a preferred form, the vacuum cord and hose holder is a hollow truncated pyramid. The base is at what be the top of a truncated pyramid. In use on the vacuum cleaner, the truncated pyramid appears upside down.

Further for the preferred form, as the hose receiver is formed in two opposing walls of the truncated pyramid, it has two arcuate, generally parabolic and symmetrical shapes, and oppositely disposed shapes. The first wing and the second wing form two opposing walls of the truncated pyramid.

In the first wing preferably is a centrally located indentation extending substantially vertically from the base of the vacuum cord and hose holder. The cord holder is situated therein. Thus, the cord may be stored between the cord holder and the first wing.

The vacuum cord and hose holder may be mounted on the vacuum cleaner in any satiable fashion. It may be secured by tape, glue, a screw, a nut and bolt, a hook and loop assembly, another fastener, or combinations. It may even be molded as a part of the vacuum cleaner itself.

While it is not desired to be bound by any particular theory, it is believed that the tapered edge of the hose receiver in the vacuum cord and hose holder assists in receiving the hose, when the hose is merely tossed at the vacuum cord and hose holder. The four upwardly extending ribs or edges of the slot assist in receiving the convolutions present in the vacuum hose and hence the vacuum hose itself.

Figure 1:
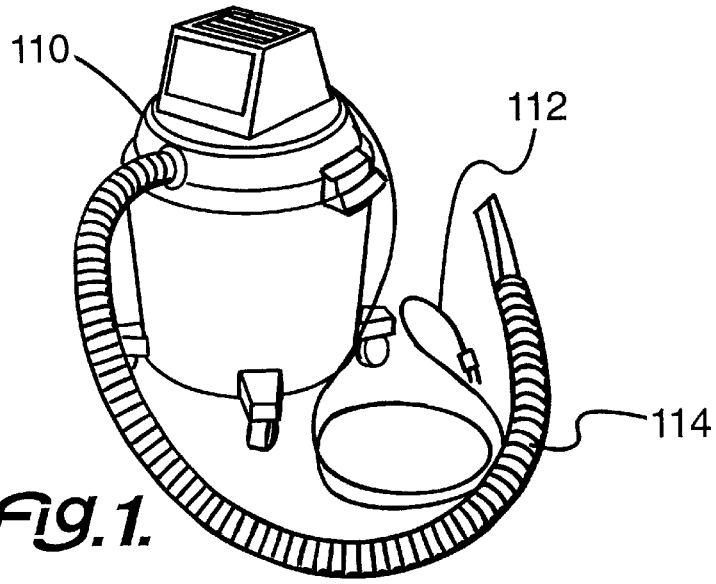
FIG. 1 depicts a perspective view of vacuum cleaner 110 in a standard disarray.
Figure 2:
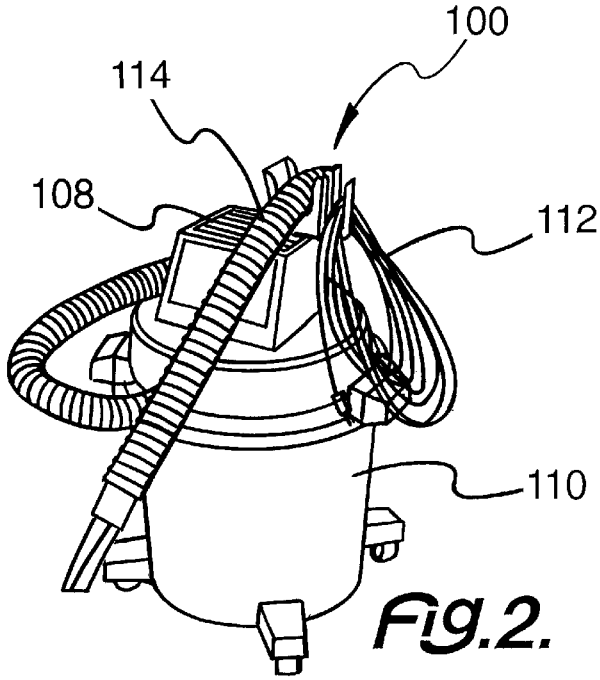
FIG. 2 depicts a perspective view of the separable vacuum cord and hose holder 100 of this invention mounted on vacuum cleaner 110.

Referring now to FIG. 1 and FIG. 2, a comparison therebetween, shows that the vacuum cord and hose holder 100 is extremely useful. In FIG. 1, vacuum cleaner 110 has cord 112 and hose 114 laying in disarray. With FIG. 2 showing vacuum cord and hose holder 100 mounted on a top portion 108 of a vacuum cleaner 110, vacuum cord 112 and vacuum hose 114 may be neatly stored and ready for further use. The vacuum cord and hose holder 100 is suitable for any type of vacuum cleaner, with vacuum cleaner 110 shown herein being a preferred use therefor.

Figure 3:
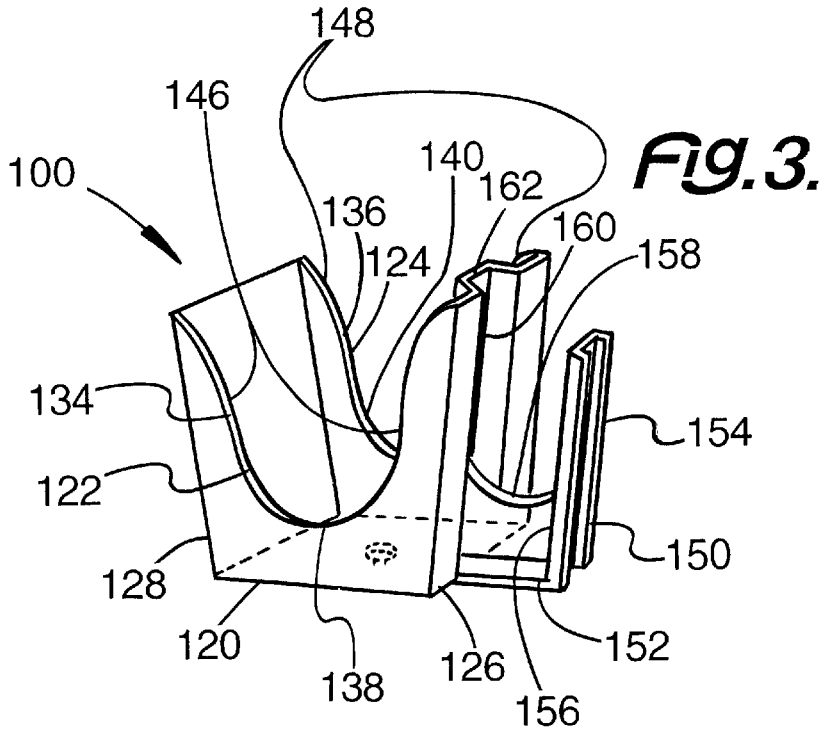
FIG. 3 depicts a perspective view of the vacuum cord and hose holder 100 of this invention.
Figure 4:
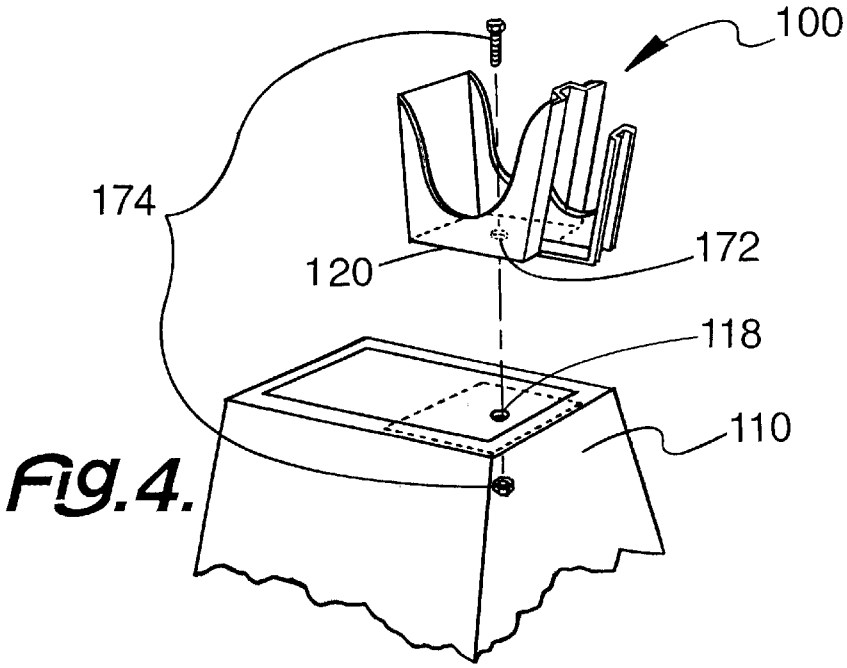
FIG. 4 depicts an exploded perspective view of vacuum cord and hose holder 100 mountable on vacuum cleaner 110 with screw assembly 160.

Adding FIG. 3 and FIG. 4 to the consideration, the vacuum cord and hose holder 100 has a base 120. Base 120 is preferably rectangular in shape, although other shapes are operable. Extending upwardly from base 120 is a first wing 122. Oppositely disposed from first wing 122 is second wing 124. Clearly, first wing 122 extends from first wing side 126 of base 120. Clearly, second wing 124 extends from second wing side 128 of base 120.

Vacuum cord and hose holder 100 also has a first slot side 134 oppositely disposed from a second slot side 136. While first slot side 134 and second slot side 136 are similar in appearance objectively, they resemble wings 122 and 124 with a first arcuate slot 138 in first slot side 132 and second arcuate slot 140 in second slot side 134.

First slot side 132 and second slot side 134 are similar in structure. First slot side 132 has a first rib pair 146 adapted to receive the hose 114 therebetween. Second slot side 134 is similar in structure and includes second rib pair 148. Second rib pair 148 cooperates with first rib pair 146 and tapered edges 144 thereof to receive hose 114 therebetween. With this design, it is possible to place hose 114 therebetween with a mere toss.

Extending from first wing side 126 is power cord hanger 150. Power cord hanger 150 has a wing base 152 extending from therefrom. Wing base 152 provides spacing from first wing side 126 and permits power cord arm 154 to extend upwardly therefrom and spaced apart from first wing side 126. If desired, hanger buttress 156 may provide support between wing base 152, power cord arm 154 and first wing side 126. Hanger buttress 156 may have a top arc 158 in order to permit power cord 114 to be received within power cord hanger 150 more efficiently.

In a preferred form, power cord hanger 150 is mounted on first wing side 126. Within first wing side 126, cord ridge 160 is present to receive, or to have mounted therein, power cord hanger 150. Cord ridge 160 provides a rectangularly cross-sectioned indentation 162 extending substantially vertically up first wing side 126. Power cord 112 is placeable between cord hanger 150 and first wing side 126. Such a structure provides a clear molding advantage for producing the vacuum cord and hose holder 100.

Adding FIG. 4 to the consideration, the vacuum cord and hose holder 100 has a nut and bolt assembly 174 for securing the same to vacuum cleaner 110. More particularly, base 120 of the vacuum cord and hose holder 100 has a base bolt aperture 172 adapted to align with the vacuum cleaner bolt aperture 118, through which a suitable nut and bolt assembly 174 may be inserted, thereby joining the cord and hose holder 100 to the vacuum cleaner 110.

Figure 5:
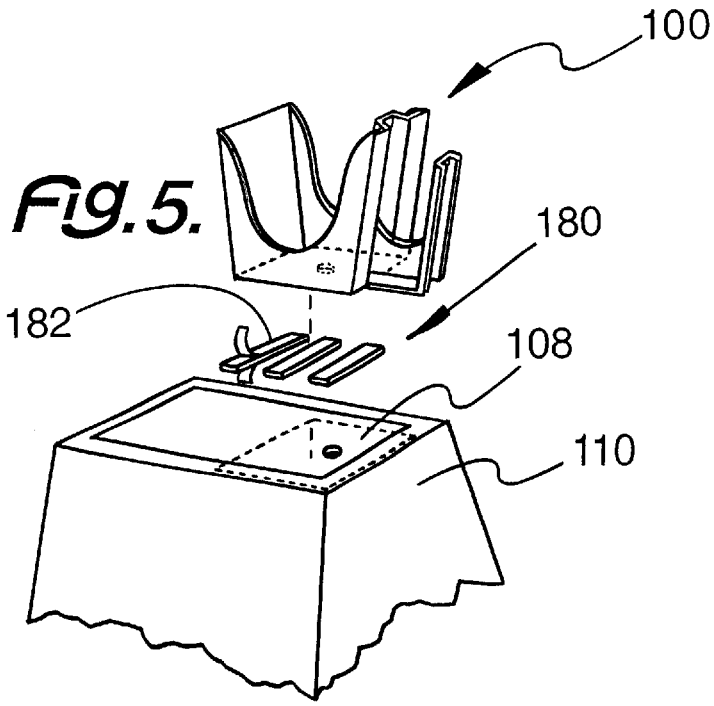
FIG. 5 depicts an exploded perspective view of vacuum cord and hose holder 100 mountable on vacuum cleaner 110 with tape assembly 180.

In FIG. 5, a double-sided tape 182 forms tape assembly 180 and provides a device for holding the cord and hose holder 100 to the vacuum cleaner 110. With tape assembly 180, it is possible to move the cord and hose holder 100 to other vacuum cleaners more efficiently.

Tape assembly 180 may include double sided adhesive tape 182 or a hook and loop assembly 184 adhered to both the vacuum hose and cord holder 100, and the top portion 108 of vacuum 110. Tape assembly 180 may provide for moving vacuum cord and hose holder 100 from one vacuum 110 to another more easily than screw assembly 170.

Figure 6:
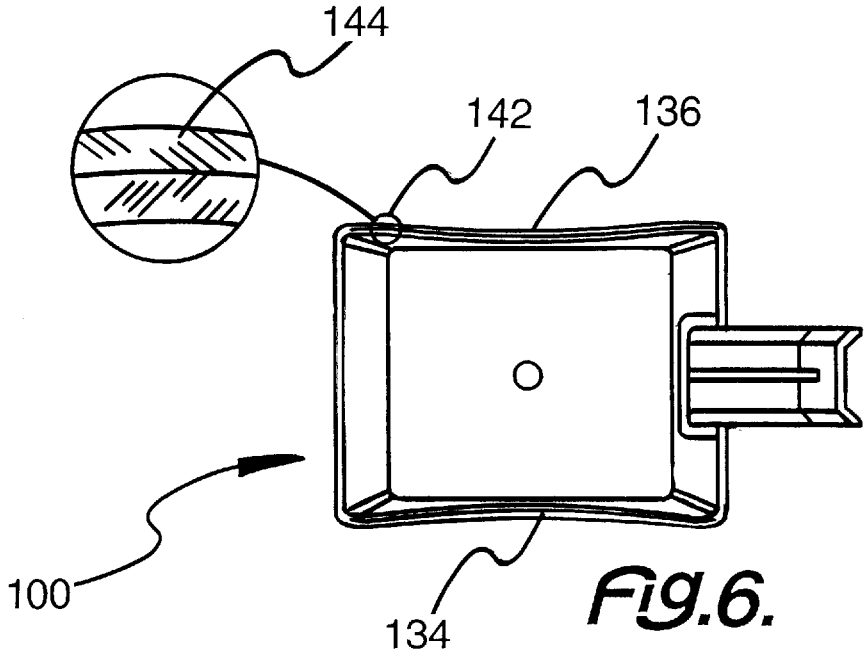
FIG. 6 depicts a top plan view of vacuum cord and hose holder 100.
Figure 7:
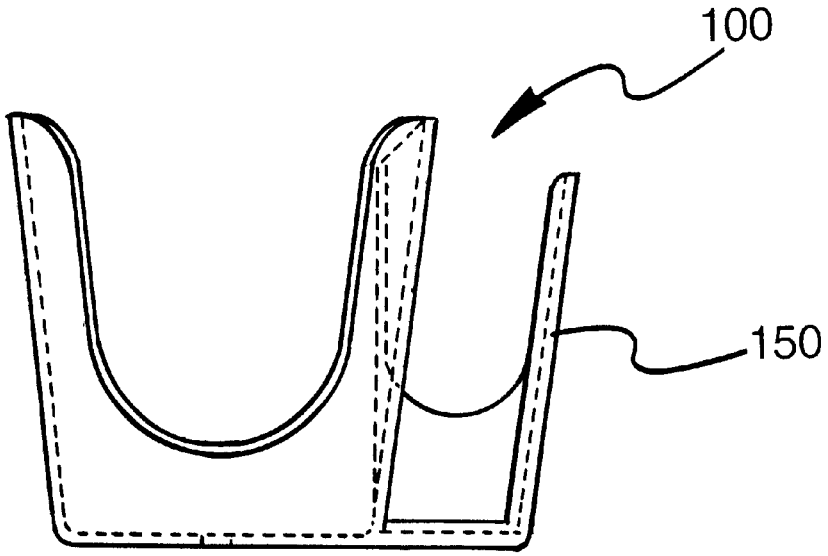
FIG. 7 depicts a side view of vacuum cord and hose holder 100.
Figure 8:
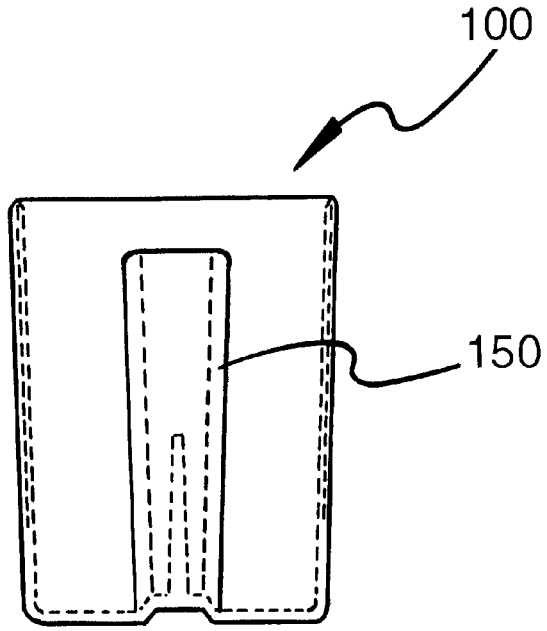
FIG. 8 depicts an end plan view of vacuum cord and hose holder 100, showing power cord hanger 150.

With a combination of FIG. 6, FIG. 7 and FIG. 8 added to the consideration, edges 142 of both first slot side 132 and second slot side 134 are provided with tapered edge 144. This tapered edge 144 permits effective receipt of vacuum hose 112. While it is not desired to be bound by any particular theory, it is postulated that the tapered edge 144 guides the vacuum hose 112 into the proper position by cooperating with hose convolutions or hose ribs 116.

Figure 9:
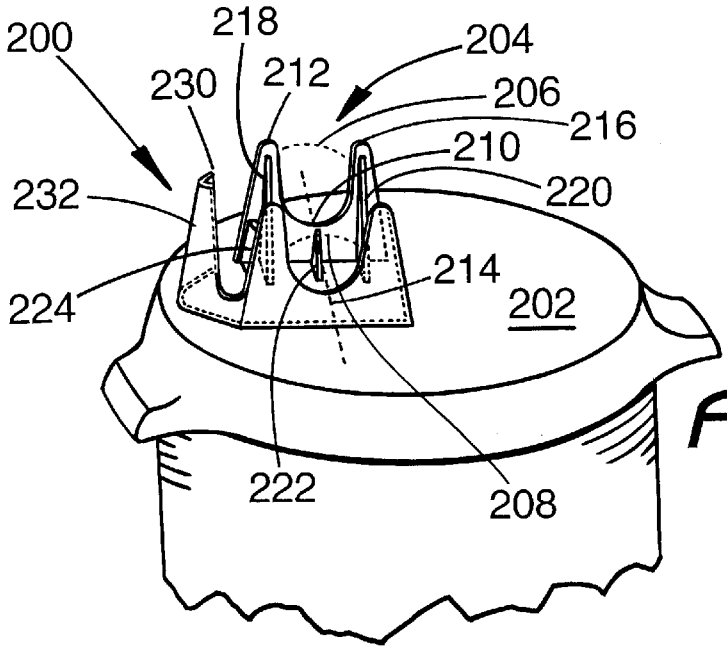
FIG. 9 depicts a perspective view of molded vacuum cord and hose holder 200.

Referring now to FIG. 9, molded vacuum cord and hose holder 200 has many of the features attributable to the separable vacuum cord and hose holder 100 relating to vacuum cleaner 110 and the storage of cord 112 and hose 114. However, molded vacuum cord and hose holder 200 is formed in vacuum top 202 during the molding process, with appropriate adjustments to simplify the molding process.

Molded hose holder 204 has first molded hose slot 206 and second molded hose slot 208, being similar in structure. First molded hose slot 206 has tapered edges in order to assist the receiving step for the vacuum hose 114. First molded hose slot 206 has a generally parabolic arc 210 in a generally flat side. On opposing sides of parabolic arc 210 are first flange 212 and second flange 216.

Since first molded hose slot 206 and second molded hose slot 208 are similar in structure and have a linear alignment axis 214, vacuum hose 114 fits therebetween. First flange 212 and second flange 216 have a first support rib 218 and second support rib 220 respectively. Adjacent to the parabolic arc 210 is third support rib 222. Second molded hose slot 208 has a similar structure.

At each end of first molded hose slot 206 and second molded hose slot 208 is arced support rib 224. Adjacent to one of arced support rib 224 is molded cord receiver 230. Molded cord receiver 230 includes an upward arcuate member 232 and, in cooperation with an adjacent arced support rib 224, forms molded cord holder 230.

Molded vacuum cord and hose holder 200 has molded hose holder 204 and molded cord receiver 230 shaped as a part of and into vacuum top 202 also. The positioning and structure supports the molding process of molded cord and hose holder 200 in relation to vacuum top 202. Such a structure is efficient, useful and easy to produce, based on the disclosures herein.

Figure 10:
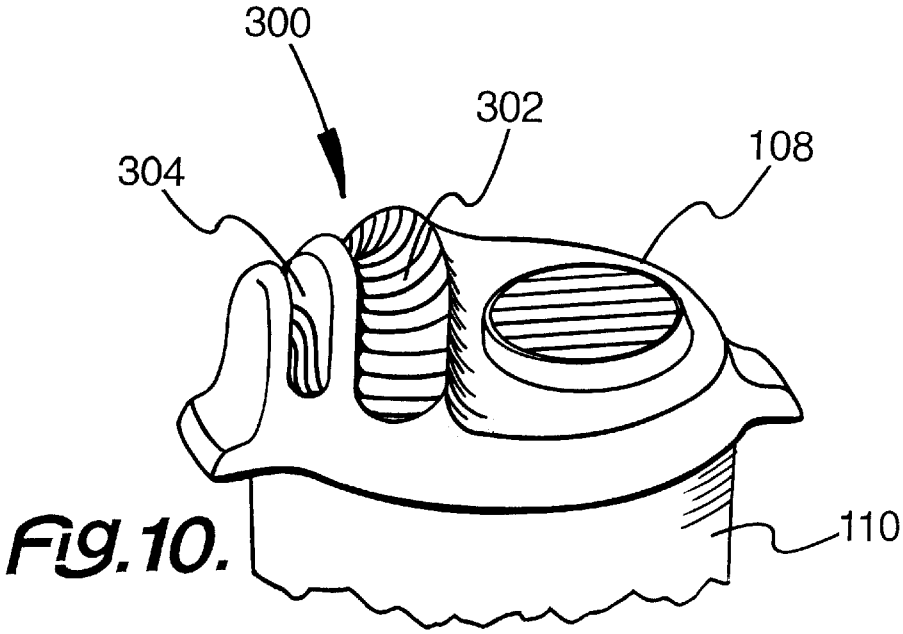
FIG. 10 depicts a perspective view of shaped vacuum cord and hose holder 300.

In FIG. 10, top portion 108 of vacuum cleaner 110 has shaped vacuum cord and hose holder 300, which provides shaped hose cradle 302 and shaped cord cradle 304 therein. Shaped hose cradle 302 and shaped cord cradle 304 provide a streamlined appearance, which has good storage and access attributes.

This application; taken as a whole with the specification, claims, abstract, and drawings; provides sufficient information for a person having ordinary skill in the art to practice the invention disclosed and claimed herein. Any measures necessary to practice this invention are well within the skill of a person having ordinary skill in this art after that person has made a careful study of this disclosure.

Because of this disclosure and solely because of this disclosure, modification of this method and apparatus can become clear to a person having ordinary skill in this particular art. Such modifications are clearly covered by this disclosure.

what is claimed and sought to be protected by Letters Patent of the United States is:

1. A vacuum cord and hose holder for keeping a hose and an electrical cord of a vacuum cleaner in position for either use or for providing ease of storage, comprising:

(a) a vacuum hose support comprising a base with a pair of oppositely disposed wings protruding therefrom providing for storage of the hose of the vacuum cleaner;

(b) a cord hanger being mounted on the vacuum hose support providing for storage of the electrical cord of the vacuum cleaner;

(c) the pair of oppositely disposed wings including a first wing and a second wing;

(d) a pair of oppositely disposed slots being situated between the first wing and second wing and being adapted to receive the hose therebetween;

(e) the pair of oppositely disposed slots including a first slot and a second slot;

(f) the first slot and the second slot combining to support the hose in a stored position and receive the vacuum hose therebetween; and (g) a cord hanger ridge being on the first wing of the vacuum hose support.

2. The vacuum cord and hose holder of claim 1 wherein:

(a) the first slot and the second slot have tapered edges; and (b) the first slot and the second slot provide two pair of ribs adapted to receive the hose therebetween.

3. The vacuum cord and hose holder of claim 2 wherein:

(a) the first slot and the second slot are parabolic, arcuate slots;

(b) the first slot and the second slot are similar in shape; and (c) the first slot and the second slot have intersecting axes of symmetry.

4. The vacuum cord and hose holder of claim 3 wherein:

(a) the cord hanger extends from the first wing of the vacuum hose support;

(b) the cord hanger has a wing base and a cord arm;

(c) the wing base provides space in order to separate the cord arm from the first wing; and (d) the cord arm extends upwardly from the wing base.

5. The vacuum cord and hose holder of claim 4 wherein:

(a) a hanger buttress connects the first wing of the vacuum hose support, the cord arm and the wing base; and (b) the cord hanger ridge includes the cord hanger.

6. The vacuum cord and hose holder of claim 5 wherein:

a. the cord hanger ridge with the hanger buttress includes a top arc in order to permit the electrical cord to be received within the cord hanger; and b. a fastening means connects the vacuum cord and hose holder to the vacuum cleaner.

7. In a vacuum cleaner having a housing, a vacuum hose and a power cord; the improvement comprising:

(a) a vacuum cord and hose holder for keeping the vacuum hose and the power cord of the vacuum cleaner in position for either use or for providing ease of storage being mounted on the vacuum cleaner;

(b) the vacuum cord and hose holder including a vacuum hose support comprising a pair of oppositely disposed wings creating a means of holding the vacuum hose and providing for storage of the hose for the vacuum cleaner;

(c) a cord hanger being mounted on the vacuum hose support, and providing for storage of the electrical cord for the vacuum cleaner;

(d) the pair of oppositely disposed wings including a first wing and a second wing;

(e) the vacuum hose support including a pair of oppositely disposed slots between the first wing and the second wing, being adapted to receive the vacuum hose therebetween;

(f) the pair of oppositely disposed slots including a first slot and a second slot, the first slot and the second slot combining to support the hose in a stored position, being adapted to receive the vacuum hose therebetween; and (g) the cord hanger being on the first wing of the vacuum hose support.

8. The vacuum cleaner of claim 7 wherein:

(a) the first slot and the second slot have tapered edges; and (b) the first slot and the second slot provide two pair of ribs adapted to receive the vacuum hose therebetween.

9. The vacuum cleaner of claim 8 wherein:

(a) the first slot and the second slot are parabolic, arcuate slots;

(b) the first slot and the second slot are similar in shape; and (c) the first slot and the second slot has intersecting axes of symmetry.

10. The vacuum cleaner of claim 9 wherein:

(a) the cord hanger extends from the first wing of the vacuum hose support;

(b) the cord hanger has a wing base and a cord arm;

(c) the wing base provides space in order to separate the cord arm from the first wing of the vacuum hose support; and (d) the cord arm extends upwardly from the wing base.

11. The vacuum cleaner of claim 10 wherein:

(a) a hanger buttress connects the first wing of the vacuum hose support, the cord arm and the wing base;

(b) a cord ridge is in the first wing of the vacuum hose support;

(c) the cord hanger extends from the cord ridge; and (d) the cord ridge includes the cord hanger.

12. The vacuum cleaner of claim 11 wherein:

(a) the hanger buttress includes a top arc in order to permit the power cord to be received within the cord hanger; and (b) a fastening means connects the vacuum cord and hose holder to the vacuum cleaner.

13. The vacuum cleaner of claim 11 wherein the vacuum hose support and the cord hanger are a molded part of the vacuum cleaner.

14. The vacuum cleaner of claim 11 wherein the vacuum hose support is secured to the vacuum cleaner with double-sided tape.

15. The vacuum cleaner of claim 11 wherein the vacuum hose support is secured to the vacuum cleaner with a nut and bolt assembly.

16. The vacuum cleaner of claim 11 wherein the vacuum hose support are secured to the vacuum cleaner with a hook and loop assembly.

17. A vacuum hose and cord holder for keeping a hose and an electrical cord of a vacuum cleaner in position for either use or ease of storage, comprising:

(a) a vacuum hose support comprising a base with a pair of oppositely disposed wings extending therefrom providing for storage of the hose of the vacuum cleaner;

(b) a cord hanger being mounted on the vacuum hose support providing for storage of the electrical cord of the vacuum cleaner;

(c) the pair of oppositely disposed wings including a first wing and a second wing;

(d) a pair of oppositely disposed slots being situated between the first wing and second wing and being adapted to receive the hose therebetween;

(e) the pair of oppositely disposed slots including a first slot and a second slot;

(f) the first slot and the second slot combining to support the hose in a stored position and receive the hose therebetween;

(g) the cord hanger being on the first wing of the vacuum hose support;

(h) the first slot and the second slot having tapered edges; and (i) the first slot and the second slot providing two pair of ribs adapted to receive the hose therebetween.

* * * * *